United States Patent [19]

Butera

[11] 4,278,068

[45] Jul. 14, 1981

[54] POSI-DRAFT STABILIZER

[76] Inventor: Anthony W. Butera, 112 Tuthill St., Port Jefferson, N.Y. 11777

[21] Appl. No.: 107,438

[22] Filed: Dec. 26, 1979

[51] Int. Cl.[3] ..... F23J 11/00

[52] U.S. Cl. ..... 126/307 A; 126/316

[58] Field of Search ..... 126/307 R, 307 A, 301, 126/316; 98/119

[56] References Cited

U.S. PATENT DOCUMENTS

| | | | |
|---|---|---|---|
| 1,343,763 | 6/1920 | Ciaccia | 126/307 A |
| 2,678,038 | 5/1954 | Edwards | 126/307 A |
| 3,121,384 | 2/1964 | Brode | 98/119 |

FOREIGN PATENT DOCUMENTS

| | | | |
|---|---|---|---|
| 37270 | 8/1935 | Netherlands | 126/307 A |

*Primary Examiner*—James C. Yeung

[57] ABSTRACT

This invention relates to a device which is installed in series with the smoke stack of an oil burner whereby the configuration of the device provides the means to act as an aerodynamic check valve and to stabilize and isolate downdraft effects in the smoke stack of a burner caused by adverse or varying wind conditions so as to insure against subsequent faulty burner operation. Also, the use of this invention, and its objectives, has application in the smoke stack of other like heating entities or duct work requiring the movement or discharge of gases; some of which are wood burning stoves, coal burning stoves or gas burning heating equipment.

1 Claim, 4 Drawing Figures

POSI-DRAFT STABILIZER

BACKGROUND OF THE INVENTION

Even though the following discussion is applicable to the aforementioned other uses, it is written in the vernacular of terms relating to a typical oil burner. This invention relates to a device the objective of which is to isolate and minimize the effects of downdraft on the efficient operation of an oil burner. Modern furnaces and boilers are fired with high efficiency types of oil burners. These burners rely upon their maximum combustion efficiency by the thorough mixing and firing of the precise quantity of air and fuel oil. This optimum air-fuel ratio is achieved after a series of tests in which the following flue gas parameters of smoke stack draft, smoke spot number, smoke stack temperature, and carbon dioxide are measured and recorded respectively. The results of said tests are then studied and an appropriate adjustment is made to one or more of the aforementioned parameters and the process is repeated until a high combustion efficiency is achieved. Even though each of these parameters are important and interrelated for maximum fuel economy, the draft and air-fuel ratio settings are the most important and if said settings are not properly adjusted and kept regulated during varying draft conditions, poor oil burner efficiency will result as well as a number of other undesirable side effects such as soot, smell and noxious fumes. Presently, in an attempt to maintain a constant and well regulated negative chimney draft and offset any said pressure fluctuations, oil fired boiler smoke stacks are installed with a draft regulator which is adjusted to some optimum negative pressure, usually specified in terms of "inches of water." This device is simple, responds to varying natural draft fluctuations, and usually consists of a swinging gate type of air modulator which works on the principle of a counterbalance and a negative draft. The counterbalance is that component of the draft regulator which is adjustable and is used to set the negative draft to some nominal value. The objective of this device is to maintain a steady regulated negative boiler breech draft by allowing a proportional input of room positive air pressure through the draft regulator to mix with the varying negative chimney draft pressure and compensate for any condition of surging negative draft caused by varying wind conditions passing over the chimney. However, some conditions of wind in combination with chimney locations can have an adverse effect on the natural chimney draft and without any applied compensation, can cause a downdraft or a positive pressure to travel down the chimney, through the boiler, and reach the oil burner. By reason that, since the simple said draft regulator commonly used today opens on an excess of chimney negative pressure; then conversely, so will it close upon exposure to a positive pressure. Thus, with the said gate forced closed, the said draft regulator will cease to perform its basic function and allow the said adverse positive pressure be reflected down and into the boiler. At this point, the burner-boiler combination will be completely subject to positive downdraft with the resulting mismatch of air-fuel ratio and consequential faulty burner operation. The principles of a negative draft regulator and the results of their applications have been described only at a cursury level for the purpose of introducing background information to illustrate the inadequacies of the present draft regulator to compensate for a downdraft condition.

SUMMARY OF THE INVENTION

The essence of the aforementioned background is to illustrate that the present draft regulator is a device which will compensate only for fluctuating natural NEGATIVE draft pressures commonly found in the smoke stack of an oil burner or any other said heating entity or ducting requiring the use of a smoke stack or chimney. Herein lies the embodiment of my invention; namely, that up to this date there is no simple device which is used in the smoke stack of an oil burner to compensate for a positive downdraft condition without discharging fumes back into the boiler room. It is the purpose of this invention to improve the operation and natural draft of a chimney by providing a simple additional device that when used in the flue pipe of a boiler in combination with a conventional draft regulator will act as an aerodynamic check valve and provide draft compensation and gas flow stabilization for conditions of both varying negative and POSITIVE downdraft pressure fluctuations.

With the aforementioned and other objects in consideration, which will appear in the following discussion, the invention consists of certain novel details of construction and combination of parts hereinafter more fully described and mentioned in the claims. Also, although the drawing shows a preferred embodiment of the invention, it is to be understood that other configurations may be made which come within the spirit and scope of the claim. These features can be more clearly understood when considered in conjunction with the accompanied drawings.

DETAILED DESCRIPTION OF THE INVENTION

Figure 1:
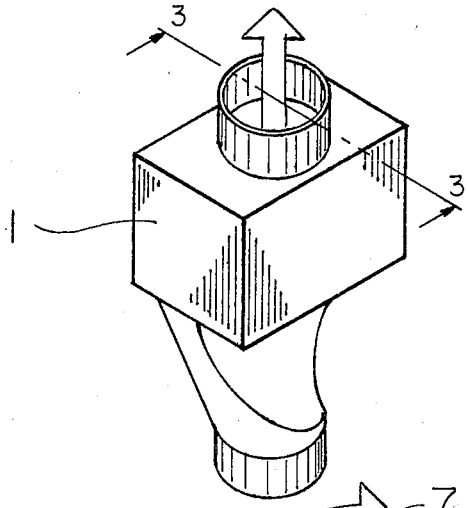
FIG. 1 is a perspective view of the Posi-draft Stabilizer.
Figure 2:
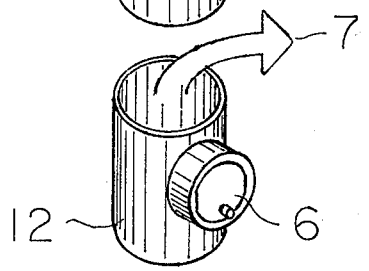
FIG. 2 is a perspective view of a typical draft regulator and smoke pipe.
Figure 3:
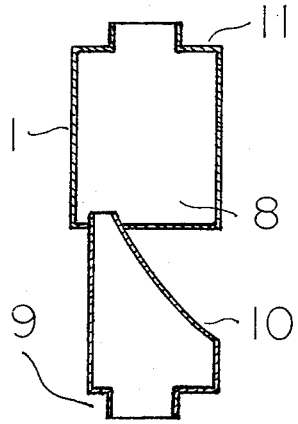
FIG. 3 is a cross section of FIG. 1 taken through A—A.
Figure 4:
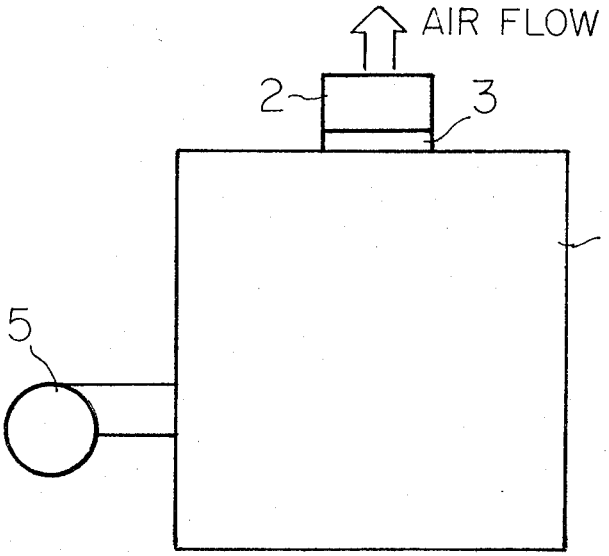
FIG. 4 is a perspective view of a typical boiler showing the breech and position of attachment of the Posi-draft Stabilizer.

The Posi-draft Stabilizer 1 is inserted in series in the smoke stack 2 of the boiler, (or furnace or wood burning stove, or coal burning stove or gas burning stove or gas carrying duct) close to the breech 3 of the boiler 4 and in the direction of the air flow from the boiler 4 as shown. The sequence of operation is now described in full detail with references being made to FIGS. 1, 2, 3 and 4. The flow of air and flue gases are as shown and pass through the system commencing with the burner 5, passing through the boiler 4, breech 3, smoke pipe 2, Posi-draft Stabilizer 1, smoke pipe 12, existing draft regulator 6 and finally out by way of an outside chimney 7. The novelty of the device is stated simply in the following analogous electrical terms of input and output impedance. The greater the mismatch in impedance, the greater is the isolation of the effects of one system on another system even though they are physicaly connected. In the Posi-draft Stabilizer the flue gases enter into the expanding chamber 8 after passing through a converging duct 10 which changes from a constant cross section 9 into said converging section 10. The said converging transition 10 from 9, circular and constant, to 10 rectangular or other geometrical shape, has a high discharge coefficient (low impedance) in the direction of flow shown and yet for a flow in the opposite direction, that is, for any flow coming down the chimney, such as a downdraft, the reverse entrance coefficient, for the rectangular section 10 is of a high impedance. This means that any flow of gases in the direction shown and up the chimney will discharge easily into the chamber 8 whereas for a flow of flue gases in the opposite direction and towards the boiler from 8, the flue gases would be inhibited in going in the opposite direction and towards the said boiler. The shape of 11 also has a higher discharge coefficient for gases going up the chimney than for those coming down the chimney. Another feature of this invention is that the velocity of the gases in going through the transition 10 will increase and possess higher kinetic energy. Herein lies another essence to my invention and that is, for any condition of downdraft, or velocity of gases coming down the chimney the said velocity would be decreased as it discharges through 10 and into the chamber 8 and also will meet a high resistance at 10. In addition to this mismatch of entrance-exit efficiencies, 10 and 11 respectively, the relative position of 10 and 11 are located so that any said low velocity flue gases coming down the chimney and into the chamber 8 would meet and be impinged upon the high exit velocity gases emerging from 10. The results of this impingment are such as to turn the downdraft upon itself and into the chamber 8 so that the wave front of positive pressure will not go into 10. Also, under normal operations, the flow velocity of gases will have stabilized themselves in a path of least resistance up the chimney thereby possessing maximum kinetic energy and thwarting any additional downdraft effects. Another explanation of this feature which makes this invention unique is that the shape and the aerodynamics of the device thereof consists of no moving parts and yet affect the flue gas kinetics in a way to achieve an objective of minimizing adverse downdraft conditions. Or, more simply stated in analogous terms, this invention acts as an aerodynamic check valve, whereby said invention can also be used in series with the smoke stack of a wood burning stove, a coal burning stove, a gas burning stove or any like heating entity, or duct work moving or discharging gases.

The draft and flow of flue gases through the boiler 4 is the sum of the results of the positive push of the fan in the oil burner 5 and the negative pull on the natural chimney draft in the breech 3 of the boiler. Since the burner fan is run with a constant speed electric motor and the total burner air output is the sum of the fan positive pressure and breech negative pressure, then the oil burner discharge air will vary in accordance to any varying breech pressure. Herein again lies the usefulness of this invention and is thus: In order to maintain an optimum air-fuel ratio, the breech pressure must remain constant. Again, and in general terms, the objective of the Posi-draft device is to maintain a constant breech draft by turning any positive downdraft upon itself and thus isolate and minimize the effects of downdraft upon the oil burner air supply.

Having now fully described my invention, I claim:

1. A device to be used in series with the smoke stack of an oil burner which will minimize the adverse effects of downdrafts on the combustion of an oil burner whereby said device also provides the function of an aerodynamic check valve and also can be used in series with the smoke stack of a wood burning, a coal burning, a gas burning stove, or any like duct to stabilize the movement or discharge of gases through said duct, said device comprising of:

an entrance section duct having a substantially circular configuration and of length to fit securely into a flue gas smoke pipe, said entrance section joined with a transition section comprising of an end plate and four substantially tapered sides to form a converging duct, said converging duct protruding into a chamber, said chamber consisting of a length of ducking, with end plates, said ends of the chamber being provided with cutouts, on one end a cutout to accept the converging discharge of the entrance transition and on the other end a cutout to accept an exit section, whereby said exit section is comprised of a substantially circular duct and is of suitable length to fit securely into an existing flue gas pipe.

* * * * *